US008745833B2

(12) United States Patent
Son et al.

(10) Patent No.: US 8,745,833 B2
(45) Date of Patent: Jun. 10, 2014

(54) METHOD OF PARTIALLY REPLACING SHELL PLATE OF TOWER OR VESSEL

(75) Inventors: Ryujitsu Son, Kanagawa (JP); Toshihiko Yamaguchi, Kanagawa (JP)

(73) Assignee: Chiyoda Corporation, Yokohama-shi (JP)

( * ) Notice: Subject to any disclaimer, the term of this patent is extended or adjusted under 35 U.S.C. 154(b) by 471 days.

(21) Appl. No.: 12/921,345

(22) PCT Filed: Mar. 5, 2009

(86) PCT No.: PCT/JP2009/054153
§ 371 (c)(1),
(2), (4) Date: Dec. 22, 2010

(87) PCT Pub. No.: WO2009/110541
PCT Pub. Date: Sep. 11, 2009

(65) Prior Publication Data

US 2011/0083312 A1 Apr. 14, 2011

(30) Foreign Application Priority Data

Mar. 6, 2008 (JP) ..... 2008-056454

(51) Int. Cl.
*B23P 6/00* (2006.01)
*B21D 39/02* (2006.01)

(52) U.S. Cl.
USPC ..... 29/402.02; 29/463

(58) Field of Classification Search
USPC ..... 29/402.08, 402.03–402.06, 402.19, 29/445, 463; 220/561, 678–679
IPC ..... E04G 23/02
See application file for complete search history.

(56) References Cited

U.S. PATENT DOCUMENTS 2,337,058 A * 12/1943 McKee ..... 228/119

FOREIGN PATENT DOCUMENTS

| | | |
|---|---|---|
| JP | 5-52396 B2 | 8/1993 |
| JP | 645971 B2 | 6/1994 |
| JP | 7-62837 A | 3/1995 |

(Continued)

OTHER PUBLICATIONS

Human translation of Fujimura et al., JP 08-270226 A.*

(Continued)

*Primary Examiner* — Alexander P Taousakis
*Assistant Examiner* — Matthew P Travers
(74) *Attorney, Agent, or Firm* — Westerman, Hattori, Daniels & Adrian, LLP

(57) ABSTRACT

Provided is a method of partially replacing a shell plate of a tower or a vessel, capable of partially replacing the shell plate of the tower or the vessel in a short construction period at low construction cost.

The method of partially replacing a shell plate of a main distillation tower is a method for replacing a cylindrical shell plate portion 2 serving as one portion of the shell plate 1 of a main distillation tower, wherein two facing parts located in the circumferential direction of the cylindrical shell plate portion 2 to be replaced are partially cut off and removed, new partial shell plates 3 are respectively attached to openings 6 generated by the removal, and the removal and the attachment are repeated, so that the cylindrical shell plate portion 2 is replaced. The new partial shell plate 3 is obtained in a case where the cylindrical shell plate portion 2 is substantially equally split into a plurality of sections in the circumferential direction.

9 Claims, 13 Drawing Sheets

(56) References Cited

FOREIGN PATENT DOCUMENTS

| | | | |
|---|---|---|---|
| JP | 8-270226 | A | 10/1996 |
| JP | 9-209582 | A | 8/1997 |
| JP | 2004-130232 | A | 4/2004 |
| JP | 3799367 | B2 | 7/2006 |
| JP | 2007-146525 | A | 6/2007 |
| JP | 2007-237206 | A | 9/2007 |
| JP | 2007-321357 | A | 12/2007 |

OTHER PUBLICATIONS

Machine translation of MIWA, JP 2007-237206 A.*
Machine translation of Ishii et al., JP 2007-321357 A.*
Human translation of Fujimura (JP 08-270226).*
Translation of Miwa (JP 2007-237206).*
Translation of Ishii (JP 2007-321357).*
International Search Report of PCT/JP2009/054153, mailing date Apr. 7, 2009.

* cited by examiner

METHOD OF PARTIALLY REPLACING SHELL PLATE OF TOWER OR VESSEL

TECHNICAL FIELD

The present invention relates to a method of partially replacing a shell plate of a tower or a vessel.

BACKGROUND ART

With a tower or a vessel such as an atmospheric distillation device of a petroleum refining apparatus and a main distillation tower of a reduced-pressure distillation apparatus, in a case where one portion of a shell plate is reduced due to corrosion as a result of long-term use, there is a need for replacement and repair.

In a case where a shell plate of a tower or a vessel having large size such as the main distillation tower is replaced, there is a method of entirely taking away the tower or the vessel collectively or separately with using a large-sized crane, and entirely replacing the tower or the vessel with a new one.

There is also a method of replacing only a corroded cylindrical shell plate portion of the shell plate. With this method, for example, in a case where the cylindrical shell plate portion to be replaced is an intermediate portion of the shell plate, an upper shell is taken away with using the large-sized crane and then the cylindrical shell plate portion to be replaced is integrally taken away, a new integral cylindrical shell plate portion is attached, and then the taken upper shell is restored.

There is also a stainless plate lining method of adhering, for example, a stainless steel thin plate of 2 to 3 mm to the entire circumference of an inner surface in a corroded and reduced portion of the shell plate by welding.

There is also a metal spraying method of spraying melted anti-corrosion metal particles such as HASTELLOY and INCONEL to the inner surface in the corroded and reduced portion of the shell plate so as to form a porous anti-corrosion film.

DISCLOSURE OF THE INVENTION

Problems to be Solved by the Invention

However, with the method of entirely replacing the tower or the vessel, since a long construction period of about several months is required, there is a problem that an operation is stopped for a long period. Alternatively, since very large space is required for installation of a large-sized crane, temporary storage of devices, and the like, there is a need for temporarily taking away peripheral devices, or the like. Moreover, there is a need for entirely replacing the tower or the vessel, taking away the peripheral devices, or the like, construction cost is increased. Furthermore, a great risk is caused in construction.

With the method of integrally taking away the corroded cylindrical shell plate portion of the shell plate and attaching the new integral cylindrical shell plate portion, there is a problem that the construction period of about three to four months is required. Alternatively, there is a problem that very large space is required for the installation of the large-sized crane, the temporary storage of the devices, or the like, the construction cost is increased, or the great risk is caused in the construction.

With the stainless plate lining method, the shell plate is not replaced. Therefore, there is a problem that work reliability is low, or repair is required in the future. Alternatively, there is a problem that a cost-effectiveness performance is low, no measure can be taken against an excessively thin shell plate due to progress of corrosion, or the like.

With the metal spraying method, there is a problem that the method only serves as an emergency process, the method is not suitable for a large work range, the sprayed film occasionally comes off in accordance with a corrosion environment, or the like.

The present invention is achieved in consideration of the above situations, and an object thereof is to provide a method of partially replacing a shell plate of a tower or a vessel, capable of partially replacing the shell plate of the tower or the vessel in a short construction period at low construction cost.

Means for Solving the Problems

In order to achieve the above object, a method of partially replacing a shell plate of a tower or a vessel according to claim 1 is a method for replacing a cylindrical shell plate portion serving as one portion of the shell plate of the tower or the vessel, wherein the cylindrical shell plate portion to be replaced is partially cut off and removed in the circumferential direction, a new partial shell plate is attached to an opening generated by the removal, and the removal and the attachment are repeated, so that the cylindrical shell plate portion is replaced.

In the invention according to claim 1, the cylindrical shell plate portion to be replaced is partially cut off and removed in the circumferential direction, the new partial shell plate is attached to the opening generated by the removal, and the removal and the attachment are repeated, so that the cylindrical shell plate portion is replaced. Therefore, it is possible to replace the cylindrical shell plate portion in a short construction period at low construction cost. That is, the cylindrical shell plate portion to be replaced is partially and successively changed with the new partial shell plate in the circumferential direction so as to be made a new cylindrical shell plate portion. Therefore, since there is no need for entirely taking away the tower or the vessel or an upper portion, a replacement task can be performed in a state that the tower or the vessel remains standing at a site. Thus, it is possible to shorten the construction period and reduce the construction cost. Particularly, due to the shortened construction period, it is possible to shorten an operation stoppage period of the whole facilities and hence reduce a loss in accordance with the operation stoppage. Since the cylindrical shell plate portion is replaced by the removal of one part of the cylindrical shell plate portion and the attachment of the new partial shell plate, members to be handled are not large-sized. Therefore, handling is easily performed, construction space is small, and the number of required workers can be reduced, so that it is possible to improve work safety. Unlike the repair with the lining method, the metal spraying method, and the like, the method is to replace the corroded and reduced portion of the shell plate with a new member. Therefore, it is possible to recover mechanical strength of the tower or vessel, and largely extend the life thereof.

With regard to the method of partially replacing the shell plate of the tower or the vessel according to claim 2, in the invention according to claim 1, the new partial shell plate is obtained in a case where the cylindrical shell plate portion is substantially equally split into a plurality of sections in the circumferential direction.

The new partial shell plate is obtained in a case where the cylindrical shell plate portion is basically equally split in the circumferential direction. However, in a case where a member such as a nozzle is placed at a split position, and the like, split parts (split lines) are required to be slightly moved in the circumferential direction. Therefore, the cylindrical shell plate portion is substantially equally split.

In the invention according to claim 2, since the new partial shell plate can be formed into the substantially same shape, it is possible to efficiently perform manufacture and attachment tasks of the new partial shall plate.

With regard to the method of partially replacing the shell plate of the tower or the vessel according to claim 3, in the invention according to claim 1 or 2, two facing parts located in the circumferential direction of the cylindrical shell plate portion are partially cut off and removed, the new partial shell plates are attached to openings generated by the removal, and the removal and the attachment are repeated.

In the invention according to claim 3, the two facing parts located in the circumferential direction of the cylindrical shell plate portion are cut off and removed, the new partial shell plates are respectively attached to the openings generated by the removal, and the removal and the attachment are repeated. Therefore, in a state that both the openings are generated, balance of a section modulus in the circumferential direction of the cylindrical shell plate portion is favorable, and strength can be stabilized.

With regard to the method of partially replacing the shell plate of the tower or the vessel according to claim 4, in the invention according to any of claims 1 to 3, size in the circumferential direction of the opening is larger than size in the circumferential direction of the new partial shell plate to be attached.

In the invention according to claim 4, a gap can be provided in the circumferential direction of the cylindrical shell plate portion between the opening generated by removing one part in the circumferential direction of the cylindrical shell plate portion and the new partial shell plate. Therefore, with using this gap, a tool such as a cord is inserted, tasks are performed, or the workers can get in and out of an interior of the shell plate through the gap. Thus, it is possible to increase workability.

With regard to the method of partially replacing the shell plate of the tower or the vessel according to claim 5, in the invention according to any of claims 1 to 4, before forming the opening, a deformation preventing reinforcing member is attached over the entire circumference of the shell plate in the vicinity of the cylindrical shell plate portion.

In the invention according to claim 5, the deformation preventing reinforcing member is attached over the entire circumference of the shell plate in the vicinity of the cylindrical shell plate portion. Therefore, during the replacement task of the cylindrical shell plate portion, it is possible to prevent deformation in a cross section of a portion of the shell plate in the vicinity of this cylindrical shell plate portion.

With regard to the method of partially replacing the shell plate of the tower or the vessel according to claim 6, in the invention according to any of claims 1 to 5, before forming the opening, a replaced portion reinforcing member is attached to the cylindrical shell plate portion.

In the invention according to claim 6, the replaced portion reinforcing member is attached to the cylindrical shell plate portion. Therefore, even in a case where the strength is largely reduced due to corrosion and the like in the cylindrical shell plate portion, enough strength is kept, and one part in the circumferential direction of the cylindrical shell plate portion can be removed.

With regard to the method of partially replacing the shell plate of the tower or the vessel according to claim 7, in the invention according to any of claims 1 to 6, a hole is formed to pass through from the inner side to the outer side of the cylindrical shell plate portion, the hole serving as a mark to determine a cut-off position for forming the opening.

In the invention according to claim 7, after a marking line is drawn corresponding to a position of an internal component or the like on the inner side of the cylindrical shell plate portion, it is possible to easily and precisely draw a marking line for cut-off for forming the opening on the outer side of the cylindrical shell plate portion with the hole serving as the mark.

With regard to the method of partially replacing the shell plate of the tower or the vessel according to claim 8, in the invention according to any of claims 1 to 7, after the new partial shell plates are manufactured and temporarily assembled to a new cylindrical shell plate portion in a plant for confirmation, the new partial shell plates are conveyed to a site where a replacement task is performed.

In the invention according to claim 8, labor of the replacement task at the site is reduced, so that it is possible to shorten the construction period.

With regard to the method of partially replacing the shell plate of the tower or the vessel according to claim 9, in the invention according to any of claims 1 to 8, a trolley beam is provided along the circumferential direction of the cylindrical shell plate portion, and a member such as the new partial shell plate is moved in the circumferential direction of the cylindrical shell plate portion with using this trolley beam.

In the invention according to claim 9, even in a case where there is a range in the circumferential direction in which a crane or the like cannot be used, such as a case where other devices come close to a periphery of the cylindrical shell plate portion, it is possible to safely and easily move the member such as the new partial shell plate to the range in the circumferential direction with using the trolley beam.

Advantage Of The Invention

According to the method of partially replacing the shell plate of the tower or the vessel of the present invention, it is possible to partially replace the shell plate of the tower or the vessel in a short construction period at low construction cost.

BRIEF DESCRIPTION OF THE DRAWINGS

FIG. 3(*a*) is a view of a nozzle; FIG. 3(*b*) is a view of a manhole; FIG. 3(*c*) is a view showing internal components for trays; and FIG. 3(*d*) is a view showing external components for new attachment.

DESCRIPTION OF REFERENCE NUMERALS

1: Shell plate
2: Cylindrical shell plate portion
3: New split plate (new partial shell plate)
6: Opening
37: Hole
61: Deformation preventing reinforcing member
63: Replaced portion reinforcing member

BEST MODES FOR CARRYING OUT THE INVENTION

Hereinafter, an embodiment of the present invention will be described with reference to the drawings.

In this embodiment, the present invention is applied to a case where a shell plate of an atmospheric distillation device of a petroleum refining apparatus or a main distillation tower of a reduced-pressure distillation apparatus is partially replaced.

Figure 1:
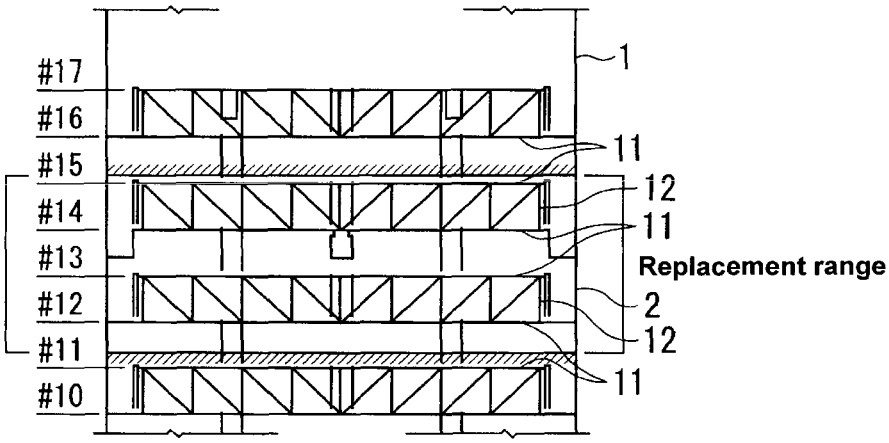
FIG. 1 is a sectional view showing a method of partially replacing a shell plate of a main distillation tower according to an embodiment of the present invention, the view showing a replacement range of a cylindrical shell plate portion.

In a method of partially replacing a shell plate of a main distillation tower according to this embodiment, firstly, a portion of the shell plate which is reduced due to corrosion or the like is examined so as to determine a range to be replaced. The main distillation tower of the present embodiment is a large-sized tower (distillation tower) having a cylindrical cross section, and a diameter of the shell plate in a trunk thereof is about 4 to 10 m. As shown in FIG. 1, a cylindrical shell plate portion 2 serving as one portion in an intermediate portion in the up and down direction of a shell plate 1 of the main distillation tower is changed with a new one. In this example, this cylindrical shell plate portion 2 to be replaced is a portion ranging from the lower side of a twelfth step tray 11 to the upper side of a fifteenth step tray 11, and has size of about 3 to 4 m for example. Even-number (twelfth and fourteenth) step trays 11 are provided on the lower surface side of major beams 12 of a framed structure, and odd-number (thirteenth and fifteenth) trays 11 are provided on the upper surface side of the major beams 12.

In this method of partially replacing the shell plate of the main distillation tower, split plates formed into a shape obtained in a case where this cylindrical shell plate portion 2 is equally split into a plurality of sections in the circumferential direction are newly manufactured. The new split plates are repeatedly fitted and welded to openings generated by partially cutting out the cylindrical shell plate portion 2 in the circumferential direction, so that the cylindrical shell plate portion 2 is changed with a new cylindrical shell plate portion.

The new split plates are preliminarily manufactured in a plant, and then conveyed to a site.

A manufacturing method of the new split plate will now be described.

It should be noted that before this manufacturing task in the plant, size, situations, and the like of parts of the main distillation tower including the cylindrical shell plate portion 2 for manufacturing the new split plate and the like are obtained, as a matter of course.

Figure 2:
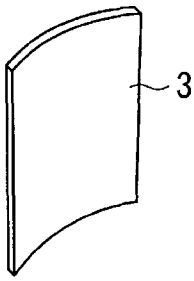
FIG. 2 is a perspective view showing a task process in a plant, the view showing a new split plate to be manufactured in the plant.
Figure 3:
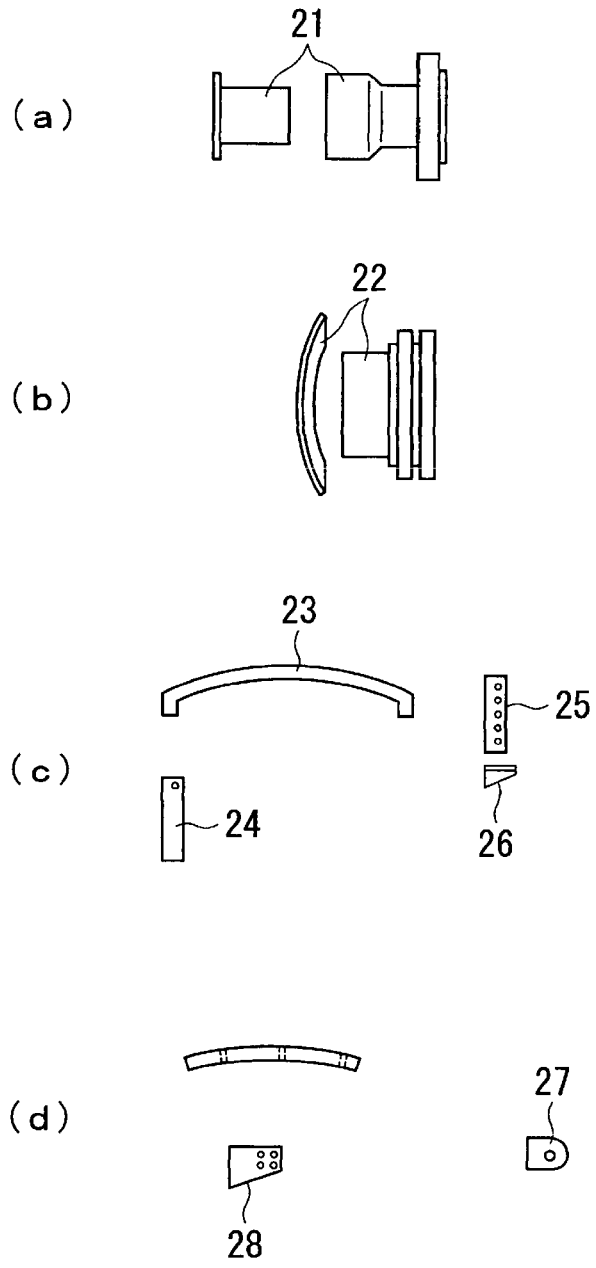
FIG. 3 is a view showing the task process in the plant, the views showing examples of portions to be manufactured in the plant.
Figure 4:
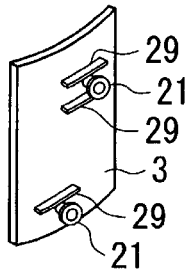
FIG. 4 is a perspective view showing the task process in the plant, the view showing a new split plate with a nozzle to be manufactured in the plant.

Firstly, as shown in FIG. 2, the new split plate (new partial shell plate) 3 is formed into a square arc plate shape (a plate shape square in a front view and arc shape in a plan view) which is obtained in a case where the cylindrical shell plate portion 2 to be replaced is equally split into a plurality of sections (twelve sections in this example) in the circumferential direction. This new split plate 3 is manufactured by cutting off a square plate material having predetermined size and then bending the material into a predetermined arc surface. Groove processing for welding is performed on outer circumference at four sides of this new split plate 3. In addition to the new split plate 3, a nozzle 21 and a manhole 22 are manufactured as shown in FIGS. 3(*a*) and (*b*), internal components for the trays (such as a support ring 23, a clamp bar 24, a bolt bar 25, and a footrest 26) are manufactured as shown in FIG. 3(*c*), and external components for new attachment (such as a movement lift lug 27, and a landing/ladder clip 28) are manufactured as shown in FIG. 3(*d*). As shown in FIG. 4, in a case of the new split plate 3 with a nozzle, the nozzle 21 is welded to the new split plate 3, so that a welded part is inspected. It should be noted that nozzle deformation preventing members 29 for preventing deformation and damage of the nozzle 21 due to contact between the nozzle 21 and other members and the like are attached in the vicinity of the nozzle 21.

Figure 5:
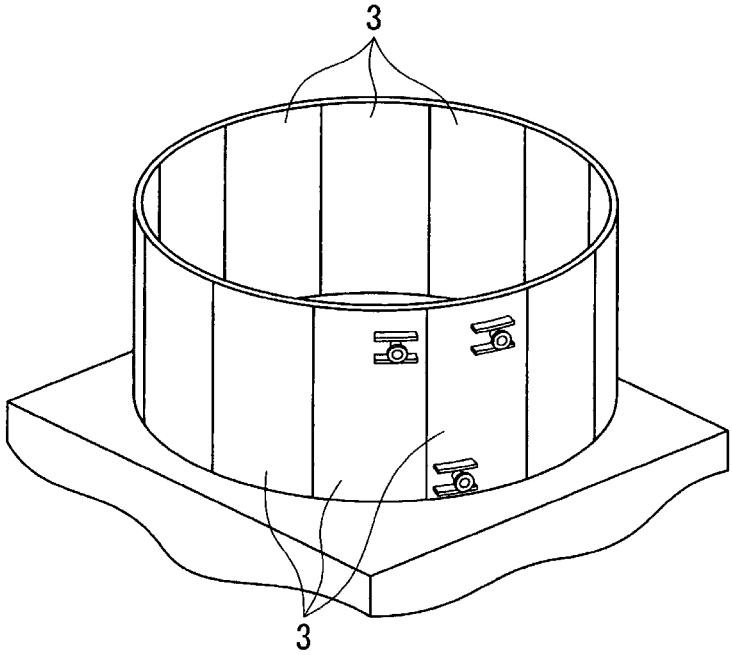
FIG. 5 is a perspective view showing the task process in the plant, the view showing a state that the new split plates are assembled and temporarily welded.

Next, as shown in FIG. 5, twelve new split plates 3 are assembled into a cylindrical shape, and temporarily welded.

Figure 6:
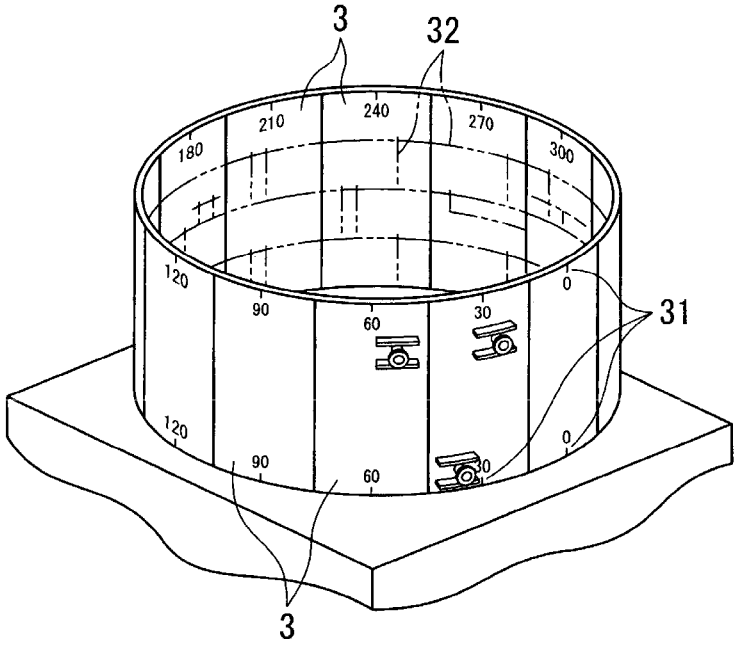
FIG. 6 is a perspective view showing the task process in the plant, the view showing a state that marking is performed on the new split plates temporarily held in a cylindrical shape.

Then, as shown in FIG. 6, reference directions 31 are respectively drawn in center parts on the upper and lower sides of the new split plates 3. Marking lines 32 for attaching the internal components such as the support rings 23, the clamp bars 24, the bolt bars 25, and the footrests 26 are drawn.

Figure 7:
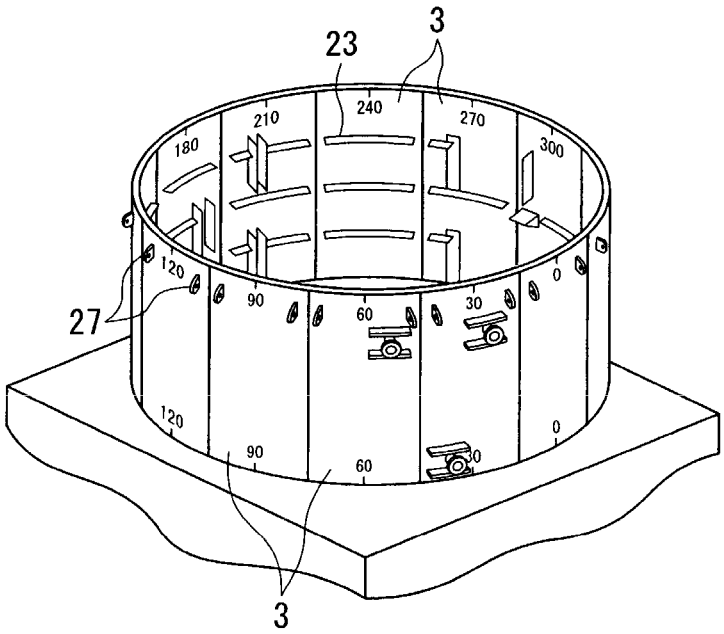
FIG. 7 is a perspective view showing the task process in the plant, the view showing a state that the internal components and the external components are attached to the new split plates temporarily held in a cylindrical shape.
Figure 8:
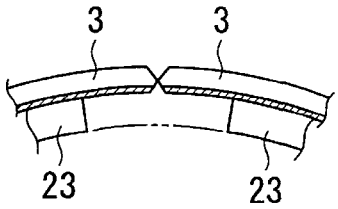
FIG. 8 is a partially cross sectional view showing the task process in the plant, the view showing a connection portion of the new split plates.

Next, as shown in FIG. 7, the internal components and the external components are attached. Alternatively, the movement lift lugs 27 for moving a trolley are attached. It should be noted that as shown in FIG. 8, members (such as the tray support rings) are not attached to connection portions of the new split plates 3 but attached at the site.

Figure 9:
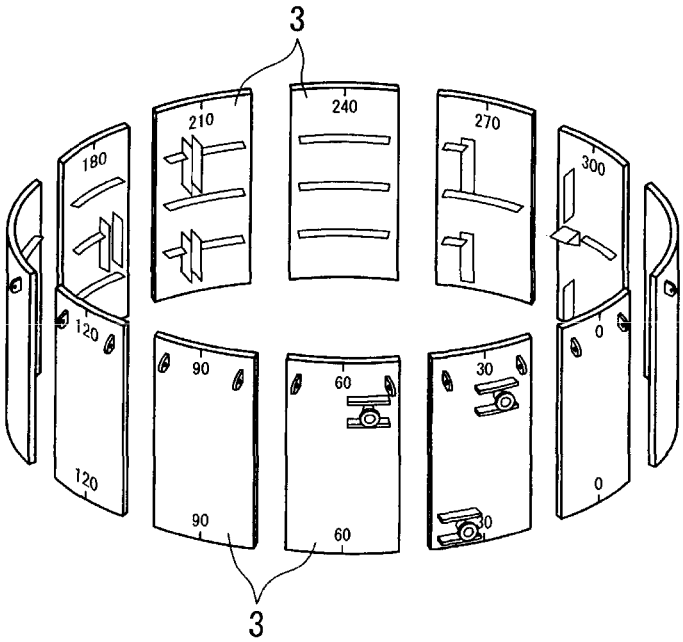
FIG. 9 is a perspective view showing the task process in the plant, the view showing a state that the new split plates temporarily held in a cylindrical shape are divided into individual new split plates.

When the attachment of the internal and external components is finished, as shown in FIG. 9, the temporary welding is removed, so that the new split plates are divided into individual new split plates 3. After that, these new split plates 3 are conveyed to the construction site.

Next, a method of replacing the cylindrical shell plate portion 2 at the site will be described.

Firstly, a foothold and a trolley station are temporarily provided in the vicinity of the cylindrical shell plate portion 2.

Then, a lagging material around the cylindrical shell plate portion 2 is disassembled.

Then, piping and the external components which disturb a replacement task are temporarily detached.

Figure 10:
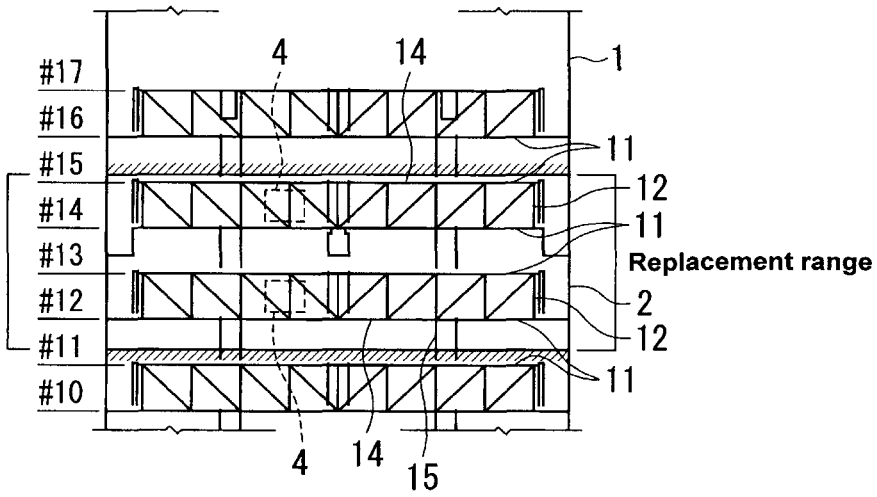
FIG. 10 is a sectional view showing a task process at a construction site, the view showing a state that exits are provided in the cylindrical shell plate portion.

Then, as shown in FIG. 10, holes are respectively formed between the twelfth step tray 11 and the thirteenth step tray of the cylindrical shell plate portion 2, and between the twelfth step tray 11 and the thirteenth step tray so as to provide exits 4. Tray floors 14, downcomers 15, and the like installed in the trays 11 in the range to be replaced of the cylindrical shell plate portion 2 are detached and conveyed to an exterior from these exits 4. The number of the exits 4 may be slightly more than two or one exit 4 may be provided. It should be noted that the major beams 12 are left as they are.

Figure 11:
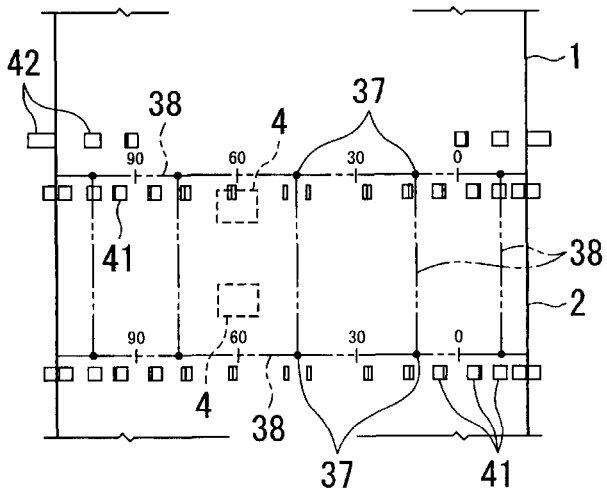
FIG. 11 is a front view showing the task process at the construction site, the view showing a state that the marking, and attachment of cutter guide clips and trolley beam attachment clips are performed.

Next, as shown in FIG. 11, cut-off positions (cut-off lines) are marked on the inner side of the cylindrical shell plate portion 2 relative to the already-attached support rings. After that, holes are formed at intersection points (reference points) of the above cut-off marking lines by a drill so as to pass through from the inner side to the outer side of the cylindrical shell plate portion 2. After that, cut-off marking lines 38 are drawn on the outer side of the cylindrical shell plate portion 2 relative to the holes 37. After that, relative to the marking lines 38 on the outer side, cutter guide clips 41 are respectively attached to the outer side (outer surface) of the shell plate 1 on the lower side of the upper and lower cut-off positions by welding so as to be spaced from each other along the circumferential direction. Trolley beam attachment clips 42 for moving already-cut portions of the shell plate and the new split plates 3 in a periphery of the cylindrical shell plate portion 2 are attached by welding. The trolley beam attachment clips 42 are attached over the entire circumference on the upper side of the cylindrical shell plate portion 2 along the circumferential direction (part of the clips 42 is omitted in the figure).

Figure 12:
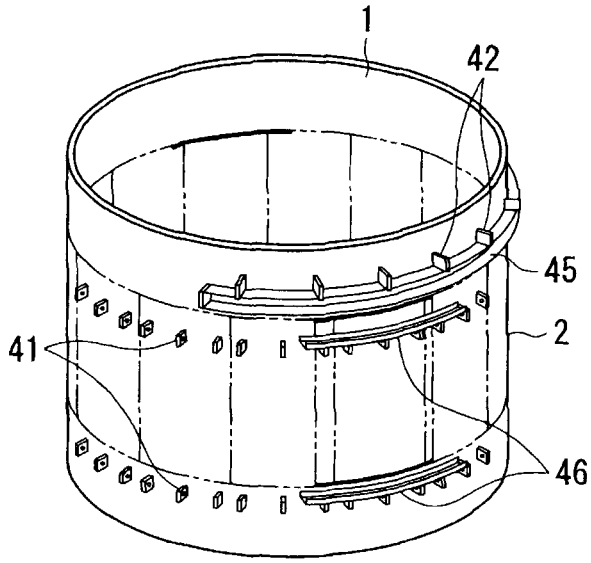
FIG. 12 is a perspective view showing the task process at the construction site, the view showing a state that the trolley beam and cutter guides are attached, and upper and lower parts of the cylindrical shell plate portion are cut off in an arc shape so as to form an opening to which the new split plate is attached.
Figure 13:
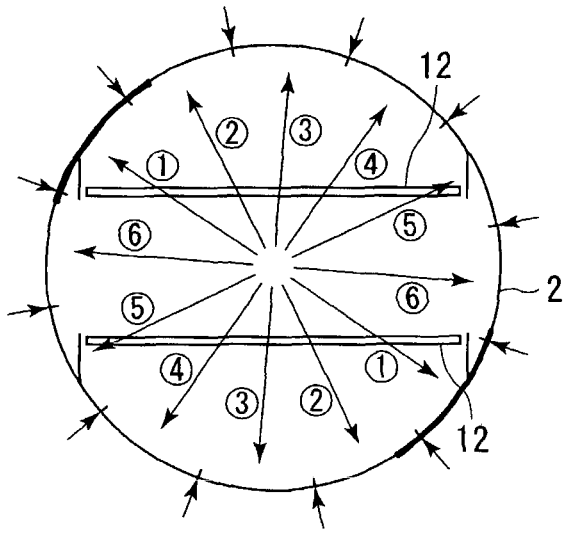
FIG. 13 is a plan view showing the task process at the construction site, the view showing a state that the upper and lower parts of the cylindrical shell plate portion are cut off in an arc shape so as to form the opening to which the new split plate is attached, and also showing the order of attachment of the new split plate.

Next, as shown in FIGS. 12 and 13, a trolley beam 45 is attached to the trolley beam attachment clips 42, so that the trolley beam 45 is provided over the entire circumference on the upper side of the cylindrical shell plate portion 2 along the circumferential direction (part of the trolley beam 45 is omitted in the figures). Alternatively, cutter guides 46 are attached to the cutter guide clips 41. The cutter guides 46 are installed in a cut-off range where the upper and lower cut-off parts of the cylindrical shell plate portion 2 are cut off at once. As the cut-off range is moved, attachment positions are moved in the circumferential direction. The major beams 12 are detached from the bolt bars, placed on the lower tray 11 (the eleventh step tray 11) of the cylindrical shell plate portion 2, and when openings described later are formed, conveyed to the exterior.

Figure 14:
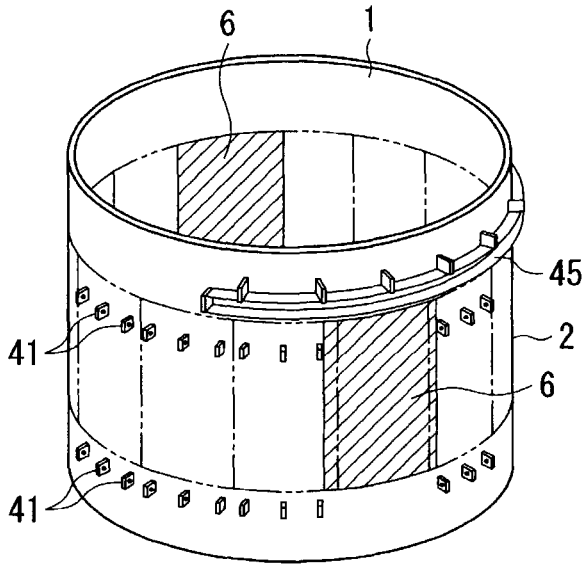
FIG. 14 is a perspective view showing the task process at the construction site, the view showing a state that the opening to which the new split plate is attached is formed at two facing parts located in the circumferential direction of the cylindrical shell plate portion.

Next, the openings for attaching the new split plates 3 are formed. The openings are provided at two facing parts located in the circumferential direction of the cylindrical shell plate portion 2 (positioned to be symmetrical with respect to a point in a plan view). That is, as shown in FIGS. 12 and 13, firstly, at the two facing part located in the circumferential direction, the upper and lower parts of the cylindrical shell plate portion 2 are respectively cut off into an arc shape along the circumferential direction with using the cutter guides 46. Length of the cut-off parts is set to be slightly longer on the both sides than the width of the new split plates 3 to be attached to the openings. After that, as shown in FIG. 14, the cylindrical shell plate portion is cut off in the up and down direction as if respectively connecting left and right ends of the upper and lower cut-off parts, so that the two facing parts located in the circumferential direction of the cylindrical shell plate portion 2 are cut out into a square arc plate shape (a plate shape square in a front view and arc shape in a plan view). The already-cut portions of the shell plate of a square arc plate shape are moved and taken away with utilizing the trolley beam 45. After that, the groove processing for welding is performed on upper and lower parts of the openings 6 formed into a square arc plate shape by cut-off as described above.

Figure 15:
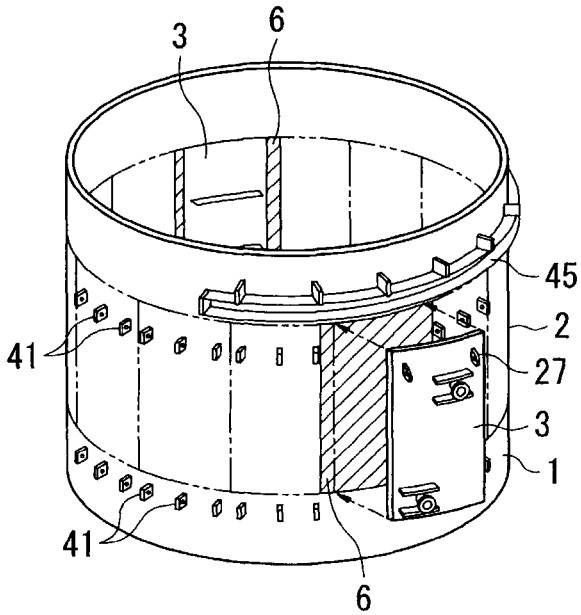
FIG. 15 is a perspective view showing the task process at the construction site, the view showing a state that the new split plate is attached to the opening.

Next, as shown in FIG. 15, the new split plates 3 are respectively attached to the openings 6 facing each other in the circumferential direction of the cylindrical shell plate portion 2. That is, the new split plates 3 are fitted into predetermined positions of the openings 6, and upper and lower parts of the new split plates 3 are respectively fixed to portions of the shell plate 1 on the upper and lower sides of the cylindrical shell plate portion 2 by welding. The new split plates 3 are moved with utilizing the trolley beam 45.

Figure 16:
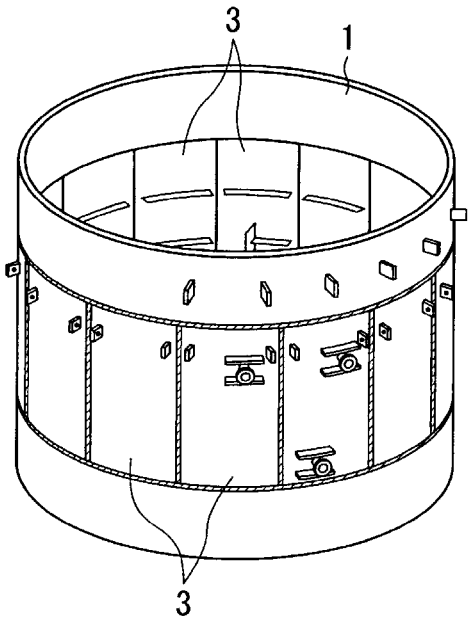
FIG. 16 is a perspective view showing the task process at the construction site, the view showing a state that the entire cylindrical shell plate portion is made a new cylindrical shell plate portion.

After that, similarly and repeatedly, the openings 6 are formed at two facing parts located in the circumferential direction of the cylindrical shell plate portion 2, and the new split plates 3 are attached to the openings 6. The adjacent new split plates 3 are butt jointed to each other by welding. The formation of the openings 6 and the attachment of the new split plates 3 are performed in the order shown by arrows and the numbers in FIG. 13 for example. That is, next to the two new split plates 3 which are already attached so as to face each other, two new split plates are successively attached so as to face each other in the circumferential direction. When the next new split plate 3 is attached next to the already-attached new split plate 3, the next new split plate 3 is butt jointed to the already-attached new split plate 3 by welding (welding in the vertical direction), and then upper and lower parts of the next new split plate 3 are respectively jointed to the portions of the shell plate 1 on the upper and lower sides of the cylindrical shell plate portion 2 by welding (welding in the lateral direction). Thereby, as shown in FIG. 16, the entire cylindrical shell plate portion 2 is made a new cylindrical shell plate portion. It should be noted that new major beams 12 are attached to the bolt bars when the new split plates 3 serving as attachment parts of the major beams 12 are attached.

It should be noted that when the formation of the openings 6 and the attachment of the new split plates 3 are performed so that portions to which the conventional (old) major beams 12 are attached are left to the end, the conventional major beams 12 preferably function as reinforcing members at the time of the replacement task of the cylindrical shell plate portion 2. Alternatively, when the formation of the openings 6 and the attachment of the new split plates 3 are firstly performed at the portions to which the conventional major beams 12 are attached, new major beams 12 are attached in place of the conventional major beams 12, and then the formation of the openings 6 and the attachment of the new split plates 3 are performed at the other parts, the new major beams 12 preferably function as the reinforcing members at the time of the replacement task.

An attachment method of the new split plates 3 with utilizing the trolley beam 45 will now be described in detail.

Figure 17:
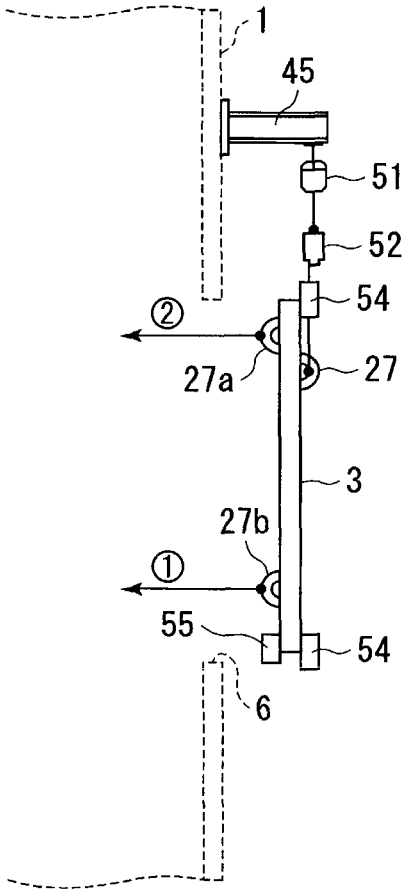
FIG. 17 is a side view showing the task process at the construction site, the view showing an attachment method of the new split plate with utilizing the trolley beam.
Figure 18:
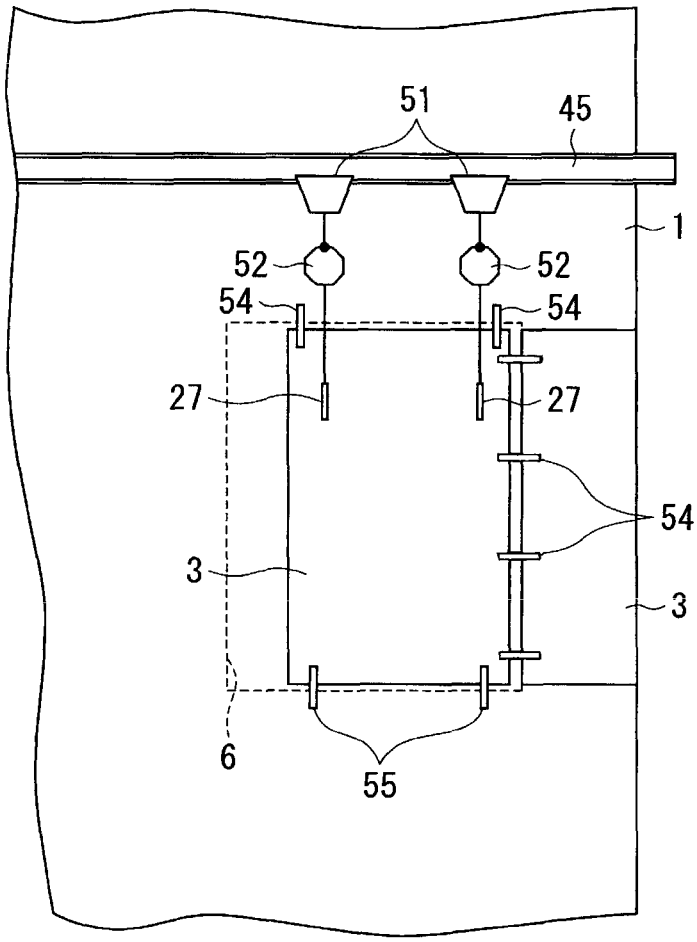
FIG. 18 is a front view showing the task process at the construction site, the view showing the attachment method of the new split plate with utilizing the trolley beam.

As shown in FIGS. 17 and 18, a pair of gear trolleys 51 is horizontally movably provided in the trolley beam 45, and chain blocks 52 are respectively attached to the gear trolleys 51. For example, in a case where the next new split plate 3 is attached next to the already-attached new split plate 3, the lift lugs 27 provided on an outer surface of the new split plate 3 are attached to the chain blocks 52, so that the new split plate 3 is retained by the chain blocks 52. After that, the new split plate is moved in front of the opening 6 of the cylindrical shell plate portion 2 by the gear trolleys 51 moving along the trolley beam 45 and the chain blocks 52 capable of moving the new split plate 3 in the up and down direction.

Temporary welding tools 54 and 55 of a square plate shape are provided in the new split plate 3. The temporary welding tools 54 are provided in upper and lower ends on the outer surface of new split plate 3 and side ends on the side of the already-attached new split plate 3. When the new split plate 3 is fitted into the opening 6, the temporary welding tools are abutted with the outer surface of the shell plate 1 and the outer surface of the already-attached new split plate 3 so as to position the new split plate relative to the opening 6 in the inside and outside direction of the opening 6. The temporary welding tools 55 are provided in lower ends on an inner surface of the new split plate 3. When the new split plate 3 is fitted into the opening 6, the temporary welding tools are abutted with an end surface of the shell plate 1 forming a lower side (the lower side) of the opening 6 so as to position the new split plate relative to the opening 6 in the up and down direction of the opening 6.

As shown in FIG. 17, in order to fit the new split plate 3 moved to front of the opening 6 into the opening 6, a lower lift lug 27*b* of two lift lugs 27*a* and 27*b* provided on the upper and lower sides of the inner surface of the new split plate 3 is firstly pulled to the side of the opening 6, so that the temporary welding tools 55 are abutted with the end surface of the shell plate 1 forming the lower side (the lower side) of the opening 6. Next, the upper lift lug 27*a* is pulled to the side of the opening 6 so as to be abutted with the outer surface of the shell plate 1 and the outer surface of the already-attached new split plate 3 as shown in FIG. 18. As described above, after the new split plate 3 is fitted into the opening 6 adjacent to the already-attached new split plate 3, the new split plate 3 is temporarily welded to the portions of the shell plate on the upper and lower sides of the cylindrical shell plate portion 2 and the already-attached split plate 3. After that, the new split plate 3 is attached to the opening 6 by permanent welding.

After the entire cylindrical shell plate portion 2 is made the new cylindrical shell plate portion with the new split plates 3, the trolley beam 45 and the cutter guides 46 are detached, and then the trolley beam clips 42 and the cutter guide clips 41 are detached. Alternatively, the movement lift lugs 27 and the nozzle deformation preventing members 29 attached to the new split plates 3 are taken away.

Figure 19:
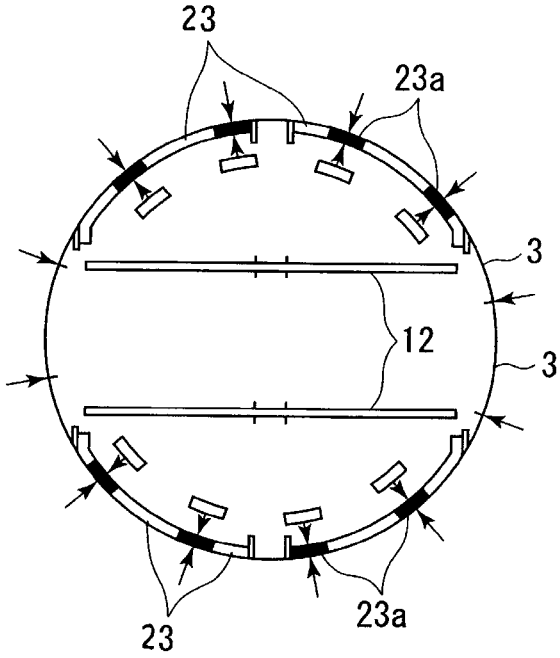
FIG. 19 is a schematic plan view showing the task process at the construction site, the view showing a state that a cutout member of a tray support ring is attached to a connection portion between the new split plates.
Figure 20:
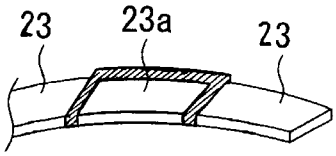
FIG. 20 is a perspective view of major parts showing the task process at the construction site, the view showing a state that the cutout member of the tray support ring is attached to the connection portion between the new split plate and the new split plate.

Next, as shown in FIGS. 19 and 20, cutout members 23*a* of the tray support rings are attached to the connection portions between the new split plates 3 by welding.

As described above, after the cylindrical shell plate portion 2 is made the new cylindrical shell plate portion, the trays are assembled.

Next, the temporarily taken-away obstructive piping and the external components are restored to the original positions.

Then, the lagging material is provided around the new cylindrical shell plate portion.

Then, the foothold and the trolley station are taken away.

In such a method of partially replacing the shell plate of the main distillation tower, the cylindrical shell plate portion 2 to be replaced is partially cut off and removed in the circumferential direction, the new split plates 3 are attached to the openings 6 generated by the removal, and the removal and the attachment are repeated, so that the cylindrical shell plate portion 2 is replaced. That is, the cylindrical shell plate portion 2 to be replaced is partially and successively changed with the new split plates 3 in the circumferential direction so as to be made the new cylindrical shell plate portion 2. Therefore, since there is no need for entirely taking away the main distillation tower or the upper portion of the upper side of the cylindrical shell plate portion 2 to be replaced, the replacement task can be performed in a state that the main distillation tower remains standing at the site. Thus, it is possible to shorten the construction period and reduce the construction cost. Particularly, due to the shortened construction period, it is possible to shorten an operation stoppage period of the whole facilities and hence reduce a loss in accordance with the operation stoppage. Since it is strongly desired that the operation stoppage period is shortened as much as possible in the field of a petroleum refining apparatus and the like, this method of replacing is effective.

Since the cylindrical shell plate portion 2 is replaced by the removal of the cut-off portions of the shell plate serving as one part of the cylindrical shell plate portion 2 and the attachment of the new split plates 3, members to be handled are not large-sized. Therefore, handling is easily performed, construction space is small, and the number of required workers can be reduced, so that it is possible to improve work safety.

Unlike the repair with the lining method, the metal spraying method, and the like, the method is to replace the corroded and reduced portion of the shell plate 1 with a new member. Therefore, it is possible to recover mechanical strength of the main distillation tower, and largely extend the life thereof.

The new split plates 3 are obtained in a case where the cylindrical shell plate portion 2 is equally split into a plurality of sections in the circumferential direction. Therefore, since the new split plates 3 can be formed into the same shape, it is possible to efficiently perform manufacture and attachment tasks of the new split plates 3. It should be noted that the new split plates 3 are obtained in a case where the cylindrical shell plate portion 2 is basically equally split in the circumferential direction. However, in a case where the member such as the nozzle 21 is placed at a split position and the like, split parts (split lines) are required to be slightly moved in the circumferential direction. In this case, the size in the circumferential direction of the new split plates 3 is slightly different.

The cut-off portions of the shell plate at the two facing parts located in the circumferential direction of the cylindrical shell plate portion 2 are cut off and removed, the new split plates 3 are respectively attached to the openings 6 generated by the removal, and the removal and the attachment are repeated. Therefore, in a state that both the openings 6 are generated, balance of a section modulus in the circumferential direction of the cylindrical shell plate portion 2 is favorable, and strength can be stabilized. Further, the size in the circumferential direction of the new split plates 3 is the same, and the openings 6 have the same size. Therefore, the balance of the section modulus in the circumferential direction of the cylindrical shell plate portion 2 is further favorable.

The size in the circumferential direction of the cut-off portions of the shell plate to be removed from the cylindrical shell plate portion 2 is set to be larger than the size in the circumferential direction of the new split plates 3 to be attached. Therefore, a gap can be provided in the circumferential direction of the cylindrical shell plate portion 2 between the openings 6 generated by removing the cut-off portions of the shell plate and the new split plates 3. Thus, with utilizing this gap, a tool such as a cord is inserted, tasks are performed, or the workers can get in and out of the interior of the shell plate through the gap. Thus, it is possible to increase workability.

The holes 37 are formed to pass through from the inner side to the outer side of the cylindrical shell plate portion 2, the holes serving as marks to determine the cut-off positions for removing the cut-off portions of the shell plate. Therefore, after the marking lines are drawn corresponding to the positions of the internal components or the like on the inner side of the cylindrical shell plate portion 2, it is possible to easily and precisely draw the marking lines for cut-off of the cut-off portions of the shell plate on the outer side of the cylindrical shell plate portion 2 with the holes 37 serving as the marks.

After the new split plates 3 are preliminarily manufactured and temporarily assembled to the cylindrical shell plate portion in the plant for confirmation, the new split plates are conveyed to the construction site where the replacement task is performed. Therefore, labor of the replacement task at the site is reduced, so that it is possible to shorten the construction period.

The trolley beam 45 is provided over the entire circumference in the circumferential direction of the cylindrical shell plate portion 2, and the members such as the cut-off portions of the shell plate and the new split plates 3 are moved in the circumferential direction of the cylindrical shell plate portion 2 with using this trolley beam 45. Therefore, even in a case where there is a range in the circumferential direction in which a crane or the like cannot be used, such as a case where other devices come close to the periphery of the cylindrical shell plate portion 2, it is possible to safely and easily move the members such as the new split plates 3 to the trolley station and the range in the circumferential direction with using the trolley beam 45. It should be noted that the trolley beam 45 can be provided in one part in the circumferential direction of the cylindrical shell plate portion 2. For example, in a case where other devices come close to the periphery of the cylindrical shell plate portion 2 and the range in the circumferential direction in which the crane or the like cannot be used is about two third of the entire circumference, this range and the trolley beam 45 may be provided.

It should be noted that in the above embodiment, in a case where there is a large reduced portion due to severe progress of corrosion of the cylindrical shell plate portion 2 to be replaced, reinforcing members are preferably provided.

Figure 21:
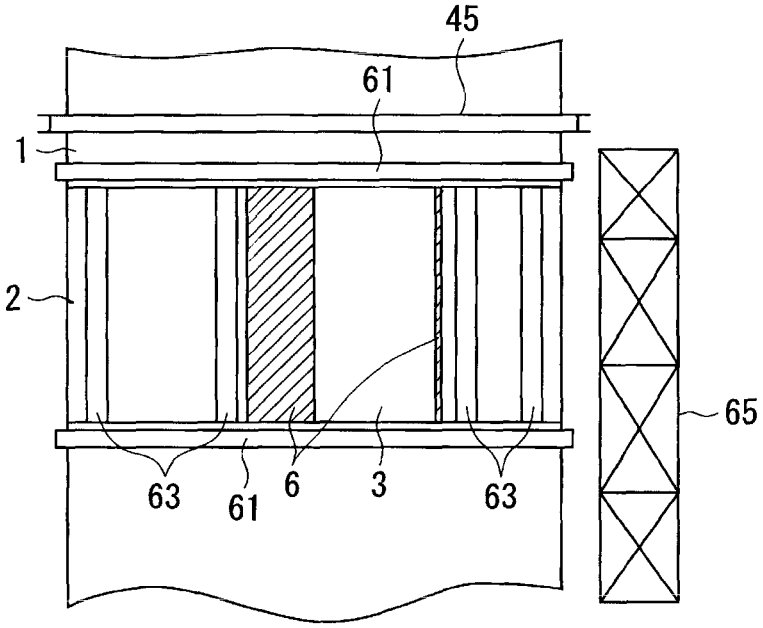
FIG. 21 is a front view showing a state that a deformation preventing reinforcing member and a replaced portion reinforcing member are provided.

As the reinforcing members, for example as shown in FIG. 21, before removing the cut-off portions of the shell plate from the cylindrical shell plate portion 2, deformation preventing reinforcing members 61 are respectively attached over the entire circumference of the outer surfaces of the shell plate 1 on the upper and lower sides in the vicinity of the cylindrical shell plate portion 2 by welding. By providing the deformation preventing reinforcing members 61, when the cut-off portions of the shell plate are removed from the cylindrical shell plate portion 2 so as to form the openings 6, or the new split plates 3 are welded, deformation in cross sections of the portions of the shell plate 1 in the vicinity of this cylindrical shell plate portion 2 can be prevented, so that it is possible to maintain a cylindrical shape (perfect circle). After the cylindrical shell plate portion 2 is made a new cylindrical member, the deformation preventing reinforcing members 61 are detached from the shell plate 1. The deformation preventing reinforcing members 61 can be for example made of shaped steel such as H-section steel. The deformation preventing reinforcing members 61 are for example wound around the entire circumference of the outer surfaces of the shell plate 1 and fixed by welding or the like. The deformation preventing reinforcing members 61 may be provided on one of the outer surfaces of the shell plate on the upper or lower side in the vicinity of the cylindrical shell plate portion 2.

Before removing the cut-off portions of the shell plate from the cylindrical shell plate portion 2, a plurality of replaced portion reinforcing members 63 extending in the vertical direction on an outer surface of the cylindrical shell plate portion 2 is attached by welding so as to be spaced form each other in the circumferential direction. By providing the replaced portion reinforcing members 63, even in a case where the strength is largely reduced due to corrosion and the like in the cylindrical shell plate portion 2, enough strength is kept, and the cut-off portions of the shell plate can be removed from the cylindrical shell plate portion 2 so as to form the openings 6. When the cut-off portions of the shell plate are removed from the cylindrical shell plate portion 2 so as to form the openings 6, the replaced portion reinforcing members 63 are removed from the cylindrical shell plate portion 2 together with the cut-off portions of the shell plate (in a state that the replaced portion reinforcing members are attached to the cut-off portions of the shell plate). The replaced portion reinforcing members 63 can be for example made of the shaped steel such as the H-section steel. The replaced portion reinforcing members 63 are for example fixed to the outer surface of the cylindrical shell plate portion 2 by welding or the like. Only one replaced portion reinforcing member 63 may be provided. Alternatively, in a case where a plurality of the replaced portion reinforcing members 63 is provided, the replaced portion reinforcing members may not be necessarily equally spaced from each other. The replaced portion reinforcing members 63 may be provided not only in the up and down direction but in other directions such as the oblique direction.

It should be noted that in FIG. 21, reference numeral 65 denotes the foothold.

In the above embodiment, the two facing parts located in the circumferential direction of the cylindrical shell plate portion 2 are successively replaced with the new split plates 3. However, instead, two parts other than the two facing parts located in the circumferential direction of the cylindrical shell plate portion 2 are cut off and removed, the new partial shell plates are attached to the openings generated by the removal, and the removal and the attachment may be repeated.

Alternatively, three or more parts which are equally spaced from each other in the circumferential direction of the cylindrical shell plate portion 2 are cut off and removed, the new partial shell plates are attached to the openings generated by the removal, and the removal and the attachment may be repeated. Further, three or more parts which are not equally spaced from each other are cut off and removed, the new partial shell plates are attached to the openings generated by the removal, and the removal and the attachment may be repeated.

Alternatively, one part in the circumferential direction of the cylindrical shell plate portion 2 is cut off and removed, the new partial shell plate is attached to the opening generated by the removal, and the removal and the attachment may be repeated.

As described above, in a case where the openings are formed in one or plural parts in the circumferential direction of the cylindrical shell plate portion 2, the number, the position, and the size of the openings are determined so as to maintain the strength preventing deformation and damage of the cylindrical shell plate portion 2 at the time of forming the openings.

In the above embodiment, the new split plate 3 is formed into a shape of the partial shell plate obtained in a case where this cylindrical shell plate portion 2 is equally split into a plurality of sections in the circumferential direction. However, instead, the new split plate may be formed into not the shape equally split but a plurality of partial shell plates having different size in the circumferential direction. It should be noted that the partial shell plate is preferably formed by splitting the cylindrical shell plate portion 2 into at least four sections in the circumferential direction.

In the above embodiment, the opening 6 is formed next to the already-attached new split plate 3, and then the next new split plate 3 is attached. However, instead, the opening 6 may be formed so as to be spaced from the already-attached new split plate 3, and then the new split plate 3 may be attached.

In the above embodiment, the size in the circumferential direction of the opening 6 to be formed is set to be larger than the size in the circumferential direction of the new split plate 3 to be attached. However, the size of the opening may be the substantially same as the size of the new split plate, and the new split plate may be attached.

In the above embodiment, the material and the like of the new split plate 3 are similar to the cylindrical shell plate portion 2. However, other materials may be used as the new split plate 3, or clad steel is used as the new split plate 3 or lining or the like is performed on an inner surface of the new split plate 3, so that corrosion resistance and the like may be enhanced.

In the above embodiment, the exits 4 are provided so that the internal components in the tower are conveyed to the exterior. However, the exits are not provided so that the internal components may be conveyed from the opening 6, or the like.

In the above embodiment, the present invention is applied to a case where the shell plate of the main distillation tower is partially replaced. However, the present invention is not limited to this but may be applied to other towers or vessels. Alternatively, after replacing the cylindrical shell plate portion serving as one portion of the shell plate of one tower or one vessel with using the present invention, as a matter of course, other cylindrical shell plate portions may be replaced.

The invention claimed is:

1. A method of partially replacing a cylindrical shell plate of a tower or a vessel, the method comprising:

replacing shell plate portions each constituting one portion of the cylindrical shell plate of the tower or the vessel, wherein the cylindrical shell plate to be replaced is partially cut off and removed as the shell plate portions in the circumferential direction, each of new partial shell plate portions is attached to an opening generated by the removal of each of the shell plate portions, the removal and the attachment are performed at different portions in the circumferential direction so that the entire cylindrical shell plate is replaced, and the method comprises consecutively replacing pairs of shell plate portions in a circumferential direction by simultaneously replacing a single pair of shell plate portions at a time, wherein each shell plate portion of each pair lay in direct opposing relationship to one another in the circumferential direction of the cylindrical shell plate.

2. The method according to claim 1, wherein each of the new partial shell plate portions has a shape corresponding to each of a plurality of sections which are obtained in a case where the cylindrical shell plate is substantially equally split into the plurality of sections in the circumferential direction.

3. The method according to claim 1, wherein the size in the circumferential direction of the opening is larger than the size in the circumferential direction of each of the new partial shell plate portions to be attached.

4. The method according to claim 3, wherein before forming the opening, a deformation preventing reinforcing member is attached over the entire circumference of the shell plate in the vicinity of the cylindrical shell plate.

5. The method according to claim 4, wherein before forming the opening, a replaced portion reinforcing member is attached to the cylindrical shell plate.

6. The method according to claim 5, wherein a hole is formed to pass through from the inner side to the outer side of the cylindrical shell plate, the hole serving as a mark to determine a cut-off position for forming the opening.

7. The method according to claim 6, wherein after the new partial shell plate portions are manufactured and temporarily assembled to a new cylindrical shell plate in a plant for confirmation, the new partial shell plate portions are conveyed to a site where the replacement is performed.

8. The method according to claim 7, wherein a trolley beam is provided along the circumferential direction of the cylindrical shell plate, and members including the new partial shell plate portions are moved in the circumferential direction of the cylindrical shell plate by using the trolley beam.

9. A method of partially replacing a cylindrical shell plate of a tower or vessel that stands in a vertical direction, comprising:

replacing shell plate portions each constituting one portion of the shell plate of the tower or the vessel while the shell plate portions other than those being replaced remain to support the tower or vessel in the vertical direction, thereby performing the replacement at a site where the tower or vessel stands by itself as it is, wherein the replacing further comprising consecutively replacing pairs of shell plate portions in a circumferential direction by simultaneously replacing a single pair of shell plate portions at a time, wherein each shell plate portion of each pair lay in direct opposing relationship to one another in the circumferential direction of the cylindrical shell plate, and wherein the cylindrical shell plate to be replaced is partially cut off and removed as the shell plate portions in the circumferential direction, each of the new partial shell plate portions is attached to an opening generated by the removal, of each of the shell plate portions, the removal and the attachment are performed so that the entire cylindrical shell plate is replaced, each of the new partial shell plate portions has a shape corresponding to each of a plurality of sections which are obtained in a case where the cylindrical shell plate is substantially equally split into the plurality of sections in the circumferential direction, and at least one of the new partial shell plate portions has a support ring that is attached to the at least one of the new partial shell portions and extends in the circumferential direction as a reinforcing member for the at least one of the new partial shell plate portions.

* * * * *